US008562756B2

(12) United States Patent
Sagawa et al.

(10) Patent No.: US 8,562,756 B2
(45) Date of Patent: Oct. 22, 2013

(54) NDFEB SINTERED MAGNET AND METHOD FOR PRODUCING THE SAME

(75) Inventors: Masato Sagawa, Kyoto (JP); Naoki Fujimoto, Kyoto (JP)

(73) Assignee: Intermetallics Co., Ltd., Kyoto (JP)

( * ) Notice: Subject to any disclaimer, the term of this patent is extended or adjusted under 35 U.S.C. 154(b) by 101 days.

(21) Appl. No.: 12/812,379

(22) PCT Filed: Jan. 9, 2009

(86) PCT No.: PCT/JP2009/000068

§ 371 (c)(1),
(2), (4) Date: Jul. 9, 2010

(87) PCT Pub. No.: WO2009/087975

PCT Pub. Date: Jul. 16, 2009

(65) Prior Publication Data

US 2010/0282371 A1 Nov. 11, 2010

(30) Foreign Application Priority Data

Jan. 11, 2008 (JP) ..... 2008-004845

(51) Int. Cl.
*H01F 1/057* (2006.01)

(52) U.S. Cl.
USPC ..... 148/101; 148/103; 148/302

(58) Field of Classification Search
None
See application file for complete search history.

(56) References Cited

U.S. PATENT DOCUMENTS

2008/0006345 A1 1/2008 Machida et al.
2008/0223489 A1* 9/2008 Nagata et al. ..... 148/101
(Continued)

FOREIGN PATENT DOCUMENTS

EP 1 843 360 A1 10/2007
EP 2 144 257 A1 1/2010
(Continued)

OTHER PUBLICATIONS

Park, K.T., "Effect of Metal-Coating and Consecutive Heat Treatment on Coercivity of Thin Nd-Fe-B Sintered Magnets," *Proceedings of the Sixteenth International Workshop on Rare-Earth Magnets and Their Applications*, 2000, pp. 257-264, published by the Japan Institute of Metals, Japan.

(Continued)

*Primary Examiner* — John Sheehan
(74) *Attorney, Agent, or Firm* — Oliff & Berridge, PLC

(57) ABSTRACT

The present invention is aimed at providing a method for producing an NdFeB sintered magnet having a higher coercivity and higher squareness of the magnetization curve than ever before. A method for producing an NdFeB sintered magnet according to the present invention includes the steps of forming a layer containing Dy and/or Tb on the surface of an NdFeB sintered magnet base material and then performing a grain boundary diffusion process for diffusing Dy and/or Tb from the aforementioned layer through the crystal grain boundaries of the magnet base material into the magnet base material by heating the magnet base material to a temperature equal to or lower than the sintering temperature thereof, and this method is characterized in that a) the content of a rare earth in a metallic state in the magnet base material is equal to or higher than 12.7 at %; b) the aforementioned layer is a powder layer formed by depositing a powder; and c) the powder layer contains Dy and/or Tb in a metallic state by an amount equal to or higher than 50 mass %.

6 Claims, 4 Drawing Sheets

| BASE NO. | Nd | Fe | B | Co | Al | Cu | O | C | N | MR VALUE |
|---|---|---|---|---|---|---|---|---|---|---|
| 1 | 14.20 | 77.06 | 6.08 | 0.98 | 0.65 | 0.092 | 0.37 | 0.41 | 0.15 | 13.40 |
| 2 | 14.13 | 77.08 | 6.08 | 1.02 | 0.65 | 0.092 | 0.45 | 0.37 | 0.13 | 13.32 |
| 3 | 14.20 | 76.83 | 5.90 | 1.04 | 0.63 | 0.082 | 0.81 | 0.40 | 0.11 | 13.14 |
| 4 | 13.68 | 78.13 | 5.99 | 0.66 | 0.60 | 0.092 | 0.36 | 0.39 | 0.10 | 12.95 |
| 5 | 14.19 | 77.04 | 5.89 | 0.77 | 0.63 | 0.092 | 0.41 | 0.82 | 0.15 | 12.94 |
| 6 | 13.25 | 79.09 | 5.91 | 0.44 | 0.57 | 0.112 | 0.28 | 0.24 | 0.12 | 12.71 |
| (Comp)1 | 13.81 | 76.90 | 6.03 | 0.99 | 0.60 | 0.102 | 1.09 | 0.39 | 0.09 | 12.61 |
| (Comp)2 | 14.10 | 76.51 | 5.93 | 1.01 | 0.58 | 0.092 | 0.77 | 0.88 | 0.14 | 12.57 |
| (Comp)3 | 13.86 | 77.01 | 5.92 | 0.97 | 0.62 | 0.092 | 0.44 | 0.53 | 0.56 | 12.48 |
| (Comp)4 | 13.67 | 76.52 | 5.82 | 1.02 | 0.52 | 0.081 | 1.99 | 0.33 | 0.03 | 11.99 |

(56) References Cited

U.S. PATENT DOCUMENTS

| | | | | |
|---|---|---|---|---|
| 2010/0119703 | A1 | 5/2010 | Sagawa | |
| 2010/0129538 | A1* | 5/2010 | Kunieda et al. | 427/127 |
| 2010/0164663 | A1* | 7/2010 | Nagata et al. | 335/302 |
| 2012/0176211 | A1 | 7/2012 | Sagawa | |

FOREIGN PATENT DOCUMENTS

| | | | |
|---|---|---|---|
| JP | A-62-74048 | | 4/1987 |
| JP | A-1-117303 | | 5/1989 |
| JP | A-2004-359873 | | 12/2004 |
| JP | A-2005-320628 | | 11/2005 |
| JP | A-2006-303435 | | 11/2006 |
| JP | A-2007-53351 | | 3/2007 |
| JP | A-2007-258455 | | 10/2007 |
| JP | A-2007-287874 | | 11/2007 |
| JP | A-2007-287875 | | 11/2007 |
| JP | A-2007-329250 | | 12/2007 |
| WO | WO 2006/043348 | A1 | 4/2006 |
| WO | WO 2006/064848 | A1 | 6/2006 |
| WO | WO 2008/032426 | A1 | 3/2008 |
| WO | WO 2008/139690 | A1 | 11/2008 |

OTHER PUBLICATIONS

Ishigaki, N. et al., "Surface Improvements on Magnetic Properties for Small-Sized Nd-Fe-B Sintered Magnets," *NEOMAX Technical Report*, 2005, pp. 15-19, vol. 15, published by Kabushiki Kaisha NEOMAX, Japan.

Machida, K. et al., "Grain Boundary Modification and Magnetic Characteristics of Nd-Fe-B Sintered Magnet," *Abstracts of Spring Meeting of Japan Society of Powder and Powder Metallurgy*, 2004, p. 1-47A, published by the Japan Society of Powder and Powder Metallurgy, Japan.

Hirota, K. et al., "Enhancement of Nd-Fe-B Sintered Magnet by Grain Boundary Diffusion," *Abstracts of Autumn Meeting of Japan Society of Powder and Powder Metallurgy*, 2005, p. 2-32A, published by the Japan Society of Powder and Powder Metallurgy, Japan.

Machida, K. et al., "Magnetic Characteristics of Nd-Fe-B Sintered Magnet with Modified Grain Boundary," *Abstracts of Autumn Meeting of Japan Society of Powder and Powder Metallurgy*, 2005, p. 2-33A, published by the Japan Society of Powder and Powder Metallurgy, Japan.

International Search Report issued in International Application No. PCT/JP2009/000068 mailed on Apr. 14, 2009 (with translation).

Written Opinion of the International Searching Authority issued in International Application No. PCT/JP2009/000068 mailed on Apr. 14, 2009 (with translation).

International Preliminary Report on Patentability issued in International Application No. PCT/JP2009/000068 on Aug. 10, 2010 (with translation).

Aug. 31, 2012 Chinese Office Action issued in Chinese Patent Application No. 200980101615.0. (with English-language translation).

Sep. 18, 2012 Japanese Office Action issued in Japanese Patent Application No. 2008-004845 (with English-language translation).

Chinese Office Action dated Jan. 4, 2012 issued in Chinese Patent Application No. 200980101615.0 (with translation).

Mar. 1, 2013 Chinese Office Action issued in Chinese Application No. 2013022600822040 (with English-language Translation).

Apr. 23, 2013 Notification of Reasons for Rejection issued in Japanese Application No. 2008-004845 with English-language translation.

Imanari et al, "Study of Microstructure of Dy-Modified Neodymium Magnet," *Collected Abstracts of the 2009 Spring Meeting of the Japan Institute of Metals*, 2009, pp. 115 (with translation).

International Search Report and International Preliminary Report on Patentability dated Sep. 28, 2010 issued in International Patent Application No. PCT/JP2010/061712.

Jun. 18, 2013 Office Action in U.S. Appl. No. 13/778,324.

Jul. 26, 2013 Chinese Office Action issued in Chinese Application No. 200980101615.0 with partial English-language translation.

Sep. 3, 2013 Notification of reason for Rejection issued in Japanese Application No. 2011-521979 with English-language translation.

* cited by examiner

Fig. 1

| BASE NO. | Nd | Fe | B | Co | Al | Cu | O | C | N | MR VALUE |
|---|---|---|---|---|---|---|---|---|---|---|
| 1 | 14.20 | 77.06 | 6.08 | 0.98 | 0.65 | 0.092 | 0.37 | 0.41 | 0.15 | 13.40 |
| 2 | 14.13 | 77.08 | 6.08 | 1.02 | 0.65 | 0.092 | 0.45 | 0.37 | 0.13 | 13.32 |
| 3 | 14.20 | 76.83 | 5.90 | 1.04 | 0.63 | 0.082 | 0.81 | 0.40 | 0.11 | 13.14 |
| 4 | 13.68 | 78.13 | 5.99 | 0.66 | 0.60 | 0.092 | 0.36 | 0.39 | 0.10 | 12.95 |
| 5 | 14.19 | 77.04 | 5.89 | 0.77 | 0.63 | 0.092 | 0.41 | 0.82 | 0.15 | 12.94 |
| 6 | 13.25 | 79.09 | 5.91 | 0.44 | 0.57 | 0.112 | 0.28 | 0.24 | 0.12 | 12.71 |
| (Comp)1 | 13.81 | 76.90 | 6.03 | 0.99 | 0.60 | 0.102 | 1.09 | 0.39 | 0.09 | 12.61 |
| (Comp)2 | 14.10 | 76.51 | 5.93 | 1.01 | 0.58 | 0.092 | 0.77 | 0.88 | 0.14 | 12.57 |
| (Comp)3 | 13.86 | 77.01 | 5.92 | 0.97 | 0.62 | 0.092 | 0.44 | 0.53 | 0.56 | 12.48 |
| (Comp)4 | 13.67 | 76.52 | 5.82 | 1.02 | 0.52 | 0.081 | 1.99 | 0.33 | 0.03 | 11.99 |

Fig. 2

| POWDER NO. | Dy | Tb | Nd | Fe | Co | Ni | Al | Cu | B | |
|---|---|---|---|---|---|---|---|---|---|---|
| 1 | 96 | - | - | - | - | - | 4.0 | - | - | $DyH_3$ MIXED |
| 2 | 86 | - | - | - | 10 | - | 4.0 | - | - | $DyH_3$ MIXED |
| 3 | 76 | - | - | - | 20 | - | 4.0 | - | - | $DyH_3$ MIXED |
| 4 | 70 | - | - | - | 20 | - | 10.0 | - | - | $DyH_3$ MIXED |
| 5 | 86 | - | - | - | - | 10.0 | 4.0 | - | - | $DyH_3$ MIXED |
| 6 | 81 | - | - | - | 10 | 5.0 | 4.0 | - | - | $DyH_3$ MIXED |
| 7 | 81 | - | - | 3.6 | 9.5 | - | 4.0 | 1.0 | 0.9 | SC PULVERIZED |
| 8 | 75 | - | - | 3.6 | 15.5 | - | 4.0 | 1.0 | 0.9 | SC PULVERIZED |
| 9 | 77 | - | - | 3.6 | 6.5 | 7.0 | 4.0 | 1.0 | 0.9 | SC PULVERIZED |
| 10 | - | 76 | - | 3.6 | 14.5 | - | 4.0 | 1.0 | 0.9 | SC PULVERIZED |
| 11 | 62 | - | 18 | 3.6 | - | 10.5 | 4.0 | 1.0 | 0.9 | SC PULVERIZED |
| 12 | 55 | - | 25 | 3.6 | - | 10.5 | 4.0 | 1.0 | 0.9 | SC PULVERIZED |
| 13 | 100 | - | - | - | - | - | - | - | - | $DyH_3$ |
| 14 | 90 | - | - | - | 10 | - | - | - | - | $DyH_3$ MIXED |
| 15 | 90 | - | - | - | - | 10.0 | - | - | - | $DyH_3$ MIXED |
| (Comp)1 | 29 | - | 26 | 13.4 | 29.0 | - | 0.3 | 1.5 | 0.8 | SC PULVERIZED |
| (Comp)2 | 23 | - | 10 | 28.0 | 11.2 | 16.8 | 10.0 | - | 1.0 | SC PULVERIZED |
| (Comp)3 | 25 | - | 10 | 31.5 | 12.6 | 18.9 | 1.0 | - | 1.0 | SC PULVERIZED |

Fig. 3

| SAMPLE NO. | BASE NO. | POWDER NO. | APPLIED AMOUNT (mg/cm²) | $H_{cJ}$ (MA/m) |
|---|---|---|---|---|
| 1 | 1 | 5 | 7.9 | 1.78 |
| 2 | 2 | 5 | 7.8 | 1.74 |
| 3 | 3 | 5 | 8.1 | 1.75 |
| 4 | 4 | 5 | 8.4 | 1.73 |
| 5 | 5 | 5 | 9.5 | 1.72 |
| 6 | 6 | 5 | 10.1 | 1.71 |
| 7 | 2 | 1 | 8.3 | 1.73 |
| 8 | 2 | 2 | 8.0 | 1.72 |
| 9 | 2 | 3 | 9.5 | 1.72 |
| 10 | 2 | 4 | 11.3 | 1.71 |
| 11 | 2 | 6 | 16.2 | 1.70 |
| 12 | 2 | 7 | 15.3 | 1.72 |
| 13 | 2 | 8 | 16.1 | 1.70 |
| 14 | 2 | 9 | 15.9 | 1.71 |
| 15 | 2 | 10 | 15.8 | 1.96 |
| 16 | 1 | 11 | 17.1 | 1.71 |
| 17 | 1 | 12 | 18.2 | 1.72 |
| 18 | 1 | 5 | 6.2 | 1.68 |
| 19 | 1 | 5 | 5.5 | 1.67 |
| (Comp)1 | (Comp)1 | 5 | 8.3 | 1.52 |
| (Comp)2 | (Comp)2 | 5 | 8.9 | 1.48 |
| (Comp)3 | (Comp)3 | 5 | 8.6 | 1.47 |
| (Comp)4 | (Comp)4 | 5 | 15.1 | 1.36 |

Fig. 4

| SAMPLE NO. | BASE NO. | THICK-NESS (mm) | POWDER NO. | APPLIED AMOUNT (mg/cm2) | $B_r$ (T) | $H_{cJ}$ (MA/m) | $H_k$ (MA/m) | SQ VALUE (%) |
|---|---|---|---|---|---|---|---|---|
| 20 | 1 | 5 | 2 | 14.0 | 1.36 | 1.69 | 1.56 | 92.2 |
| 21 | 2 | 5 | 2 | 16.0 | 1.37 | 1.68 | 1.55 | 92.1 |
| 22 | 3 | 5 | 5 | 15.0 | 1.37 | 1.63 | 1.47 | 90.2 |
| 23 | 1 | 6 | 5 | 18.0 | 1.37 | 1.62 | 1.48 | 91.2 |
| 24 | 2 | 6 | 1 | 20.0 | 1.38 | 1.62 | 1.48 | 91.4 |
| 25 | 3 | 6 | 5 | 19.0 | 1.37 | 1.61 | 1.45 | 90.3 |
| (Comp)5 | 1 | 5 | (Comp)1 | 15.0 | 1.37 | 1.39 | 1.20 | 86.0 |
| (Comp)6 | 3 | 5 | (Comp)2 | 17.0 | 1.38 | 1.38 | 1.17 | 84.5 |
| (Comp)7 | 2 | 6 | (Comp)1 | 17.0 | 1.37 | 1.36 | 1.15 | 84.5 |
| (Comp)8 | 2 | 6 | (Comp)3 | 18.0 | 1.38 | 1.35 | 1.13 | 83.4 |
| (Comp)9 | (Comp)2 | 5 | 5 | 9.8 | 1.38 | 1.45 | 1.21 | 83.4 |
| (Comp)10 | (Comp)3 | 5 | 5 | 10.1 | 1.38 | 1.44 | 1.18 | 82.1 |
| (Comp)11 | (Comp)4 | 5 | 5 | 9.7 | 1.39 | 1.36 | 1.01 | 74.6 |

Fig. 5

| SAMPLE NO. | BASE NO. | POWDER NO. | APPLIED AMOUNT (mg/cm2) | $H_{cJ}$ (MA/m) |
|---|---|---|---|---|
| 26 | 2 | 13 | 10.1 | 1.63 |
| 27 | 2 | 14 | 11.2 | 1.62 |
| 28 | 2 | 15 | 11.5 | 1.60 |

Fig. 6

| BASE NO. | Nd | Dy | Pr | Fe | B | Co | Al | Cu | O | C | N | MR VALUE |
|---|---|---|---|---|---|---|---|---|---|---|---|---|
| 11 | 10.52 | 0.48 | 3.19 | 77.10 | 5.96 | 1.01 | 0.56 | 0.09 | 0.53 | 0.42 | 0.15 | 13.25 |
| 12 | 10.71 | 1.00 | 2.41 | 77.18 | 5.91 | 1.00 | 0.70 | 0.09 | 0.41 | 0.43 | 0.16 | 13.32 |

Fig. 7

| SAMPLE NO. | BASE NO. | THICK-NESS (mm) | POWDER NO. | APPLIED AMOUNT (mg/cm2) | $B_r$ (T) | $H_{cJ}$ (MA/m) | $H_k$ (MA/m) | SQ VALUE (%) |
|---|---|---|---|---|---|---|---|---|
| 29 | 1 | 3.5 | 1 | 9.2 | 1.33 | 1.80 | 1.62 | 90.1 |
| 30 | 2 | 3.5 | 2 | 9.7 | 1.34 | 1.82 | 1.64 | 90.1 |
| 31 | 3 | 3.5 | 9 | 8.9 | 1.36 | 1.70 | 1.54 | 90.3 |
| 32 | 11 | 3.5 | 5 | 9.1 | 1.30 | 2.09 | 1.94 | 92.9 |
| 33 | 11 | 3.5 | 9 | 8.8 | 1.32 | 2.03 | 1.89 | 93.2 |
| 34 | 12 | 3.5 | 5 | 9.5 | 1.27 | 2.29 | 2.14 | 93.3 |
| 35 | 12 | 3.5 | 9 | 10.2 | 1.29 | 2.21 | 2.06 | 93.4 |

NDFEB SINTERED MAGNET AND METHOD FOR PRODUCING THE SAME

TECHNICAL FIELD

The present invention relates to a method for producing a high-coercivity NdFeB sintered magnet and also to an NdFeB sintered magnet produced by this method.

BACKGROUND ART

NdFeB sintered magnets are used in a motor for hybrid cars and other machines, and the demand for such magnets is expected to continue to expand in the future. Accordingly, it is desired to further increase their coercivity $H_{cJ}$. One commonly known method for increasing the coercivity $H_{cJ}$ of NdFeB sintered magnets is to replace some of the neodymium (Nd) atoms with dysprosium (Dy) or terbium (Tb) atoms. However, Dy and Tb are scarce resources and unevenly distributed in the world. Another problem is that the aforementioned replacement of the elements lowers the residual flux density $B_r$ and the maximum energy product $(BH)_{max}$ of the NdFeB sintered magnet.

Patent Document 1 discloses the technique of depositing at least one element selected from Nd, Pr, Dy, Ho and Tb on the surface of an NdFeB sintered magnet to prevent a decrease in the coercivity that occurs when the surface of the NdFeB sintered magnet is processed to make a thin film of it or for other purposes. Patent Document 2 discloses the technique of diffusing at least one element selected from Tb, Dy, Al and Ga in the surface of the NdFeB sintered magnet to suppress an irreversible demagnetization that occurs at high temperatures.

In recent years, it has been found that $H_{cJ}$ of an NdFeB sintered magnet can be increased, with only a minor decrease in $B_r$, by adhering Dy or Tb to the surface of the magnet and then heating it at 700° to 1000° C. (Non-Patent Documents 1 to 3). Dy or Tb adhered to the magnet's surface is transported through the grain boundaries of the sintered body to the inner regions thereof, and diffuses from the grain boundaries into each grain of the main phase, i.e. $R_2Fe_{14}B$, where R is a rare-earth element (which process is called the "grain boundary diffusion"). In this process, since the R-rich phase of the grain boundaries is liquefied by heat, the diffusion rate of Dy or Tb through the grain boundaries is much higher than their diffusion rate from the boundaries into the grains of the main phase. By utilizing this difference in the diffusion rate and appropriately regulating the temperature and time of the heat treatment, one can create, over the entirety of the sintered body, a state where the concentration of Dy or Tb is high only in the region of the grains of the main phase the boundaries (surface region) in the sintered body. The coercivity $H_{cJ}$ of an NdFeB sintered magnet depends on the condition of the surface region of the grains of the main phase; the presence of crystal grains with high Dy/Tb concentrations in the surface region provides the NdFeB sintered magnet with a high coercivity. Although the increase in the concentration of Dy or Tb decreases $B_r$ of the magnet, the decrease in $B_r$ of the whole main-phase grain is negligible since it occurs merely in the surface region of each grain of the main phase. In this manner, a high-performance magnet whose $B_r$ is comparable to that of the NdFeB sintered magnet with no element replaced with Dy or Tb can be produced. This technique is called the grain boundary diffusion method.

Some industrial methods for producing an NdFeB sintered magnet by the grain boundary diffusion method have already been published. One of those methods includes heating an NdFeB sintered magnet after forming a layer of fine powder of a fluoride or oxide of Dy or Tb on its surface; another method includes embedding an NdFeB sintered magnet in the mixture of a powder of a fluoride of Dy or Tb and a powder of calcium hydride, and heating the magnet in that state (Non-Patent Documents 4 and 5; Patent Document 3).

More recently discovered methods for attaining a high coercivity include depositing an alloy powder composed of Dy or Tb and another kind of metal (Patent Document 4), or depositing a mixture of a powder of a fluoride of Dy or Tb and one or more powders selected from Al, Cu and Zn (Patent Document 5), on the surface of an NdFeB sintered magnet body, and then performing the heat treatment.

Patent Document 1: Japanese Unexamined Patent Application Publication No. S62-074048

Patent Document 2: Japanese Unexamined Patent Application Publication No. H01-117303

Patent Document 3: Pamphlet of International Publication No. W02006/043348

Patent Document 4: Japanese Unexamined Patent Application Publication No. 2007-287875

Patent Document 5: Japanese Unexamined Patent Application Publication No. 2007-287874

Patent Document 6: Japanese Unexamined Patent Application Publication No. 2007-053351

Patent Document 7: Japanese Unexamined Patent Application Publication No. 2006-303435

Non-Patent Document 1: K. T. Park et al., "Effect of Metal-Coating and Consecutive Heat Treatment on Coercivity of Thin Nd—Fe—B Sintered Magnets", *Proceeding of the Sixteenth International Workshop on Rare-Earth Magnets and their Applications* (2000), pp. 257-264.

Non-Patent Document 2: Naoyuki Ishigaki et al., "Neojimu Kei Bishou Shouketsu Jishaku No Hyoumen Kaishitsu To Tokusei Koujou (Surface Improvements on Magnetic Properties for Small-Sized Nd—Fe—B Sintered Magnets)", *NEOMAX GIHOU* (*NEOMAX Technical Report*), published by Kabushiki Kaisha NEOMAX, vol. 15(2005), pp. 15-19

Non-Patent Document 3: Ken-ichi Machida et al., "Nd—Fe—B Kei Shouketsu Jishaku No Ryuukai Kaishitsu To Jiki Tokusei (Grain Boundary Modification and Magnetic Characteristics of NdFeB Sintered Magnet)", *Funtai Funmatsu Yakin Kyoukai Heisei* 16 *Nen Shunki Taikai Kouen Gaiyoushuu* (*Speech Summaries of* 2004 *Spring Meeting of Japan Society of Powder and Powder Metallurgy*), published by the Japan Society of Powder and Powder Metallurgy, 1-47A Non-Patent Document 4: Kouichi Hirota et al., "Ryuukai Kakusan Hou Ni Yoru Nd—Fe—B Kei Shouketsu Jishaku No Kou Hojiryoku-ka (Enhancement of NeFeB Sintered Magnet by Grain Boundary Diffusion)", *Funtai Funmatsu Yakin Kyoukai Heisei* 17 *Nen Shunki Taikai Kouen Gaiyoushuu* (*Speech Summaries of* 2005 *Spring Meeting of Japan Society of Powder and Powder Metallurgy*), published by the Japan Society of Powder and Powder Metallurgy, p.143

Non-Patent Document 5: Ken-ichi Machida et al., "Ryuukai Kaishitsu Gata NdFeB Sintered Magnet No Jiki Tokusei (Magnetic Characteristics of NdFeB Sintered Magnet with Modified Grain Boundary)", *Funtai Funmatsu Yakin Kyoukai Heisei* 17 *Nen Shunki Taikai Kouen Gaiyoushuu* (*Speech Summaries of* 2005 *Spring Meeting of Japan Society of Powder and Powder Metallurgy*), published by the Japan Society of Powder and Powder Metallurgy, p.144

DISCLOSURE OF THE INVENTION

Problem to be Solved by the Invention

The aforementioned conventional techniques have the following problems:

(1) The techniques described in Patent Documents 1 and 2 are rather ineffective in improving the coercivity.

(2) Depositing a component containing Dy or Tb on the magnet's surface by a sputtering or ion-plating process is impracticably expensive.

(3) The technique of adhering a component containing Dy or Tb by applying a powder of $DyF_3$, $Dy_2O_3$, $TbF_3$ or $Tb_2O_3$ on the magnet's surface (Patent Document 3) is advantageous in that its process cost is low. However, the coercivity attained by this technique is rather low.

(4) The techniques disclosed in Patent Documents 4 and 5 are not particularly advantageous to the techniques of Patent Document 3 and Non-Patent Document 4. The coercivity attained by those techniques are also rather low.

That is, for a practically usable magnet having an adequately large pole area and a thickness of 3 mm or greater, the conventional techniques mentioned in (3) and (4) cannot attain a coercivity higher than 1.6 MA/m if the grain boundary diffusion process is performed using Dy (which has far more abundant resources than Tb) and a base material (an NdFeB sintered magnet before the grain boundary diffusion process) containing neither Dy nor Tb.

For an NdFeB sintered magnet having an adequately large pole area and a thickness of 3 mm or greater, none of the previously published documents relating to the grain boundary diffusion method have reported the case where $H_{cJ}$ reached 1.5 MA/m under the condition that a base material containing neither Dy nor Tb was used. The second example of Patent Document 3 discloses the case where $H_{cJ}$=1.47 MA/m was attained by a grain boundary diffusion process using a powder of an acid fluoride of Dy for a magnet of 3 mm in thickness. However, in this case, the base material contained 1 at % of Tb.

One graph presented in Non-Patent Document 4 shows that HcJ≈1.2 MA/m for a thickness of 3 mm was attained by a grain boundary diffusion process using $TbF_3$. If the grain boundary diffusion process using $DyF_3$ is performed on the same 3-mm-thick NdFeB sintered magnet, the resultant value of $H_{cJ}$ will be probably much smaller than 1.2 MA/m since the coercivity-improving effect obtained by the grain boundary diffusion of $DyF_3$ is much lower than that of $TbF_3$. Patent Document 4 discloses the case where $H_{cJ}$=1.178 MA/m was obtained by a grain boundary diffusion process of an alloy powder composed of Nd, Dy, Al, Cu, B, Fe and Co with a Dy content of 15 at % (approx. 30 mass %) for a 2-mm-thick NdFeB sintered magnet containing neither Dy nor Tb. In another example, in which an alloy powder containing 15 at % (approx. 30 mass %) of Dy with a variety of elements added thereto was used, the maximum level of $H_{cJ}$ that could be attained for an NdFeB sintered magnet having a thickness of 2.5 mm was 1.290 MA/m.

In Patent Document 5, the $H_{cJ}$ values obtained by a grain boundary diffusion process using a mixture of $DyF_3$ powder and Al powder for a 2-mm-thick NdFeB sintered magnet free of Dy are within a range from 1.003 to 1.082 MA/m. The document claims that a maximum $H_{cJ}$ value of 1.472 MA/m can be attained by a grain boundary diffusion method using a mixture of Zn powder and $DyF_3$ powder for a 4-mm-thick NdFeB sintered body containing neither Dy nor Tb.

In any of the previously mentioned documents, the coercivity-increasing effect of the grain boundary diffusion method is extremely low for an NdFeB sintered magnet having a relatively large thickness of 5 mm or greater, or 6 mm or greater. In view of this problem, for example, Patent Document 6 discloses the idea of forming a slit on the surface of a thick magnet so that the grain boundary diffusion effect can reach deep inside the magnet, while Patent Document 7 proposes the attempt of improving the heat resistance of a thick magnet by enhancing the magnet's coercivity only in the vicinity of its surface by the grain boundary diffusion method. However, the idea proposed in Patent Document 6 causes detriments to the use of the magnet, such as an increase in the work cost or surface treatment cost and a decrease in its mechanical strength. The proposal made in Patent Document 7 cannot be applicable in the case where a high reliability is required. Improving the coercivity of NdFeB sintered magnets has been increasingly important as the application range of the magnets expands to relatively large-sized motors and generators. In these applications, a magnet with a thickness of 5 mm or greater, or 6 mm or greater, is strongly demanded. Meeting such a need is an extremely important task.

Another problem relating to the grain boundary diffusion method is that it has been impossible to create an NdFeB sintered magnet having a magnetization curve with high squareness when the magnet is relatively thick. The low squareness is due to the fact that the grain boundary diffusion effect does not evenly spread over the entire magnet. That is, the amount of Dy or Tb distributed by the grain boundary diffusion is large in the vicinity of the surface of the base material but becomes smaller as it goes deeper inside. Having a high squareness is an indispensible requirement for high-quality magnets.

The problem to be solved by the present invention is to obtain a means capable of attaining a high coercivity that could not be attained by conventional techniques. Specifically, the means should attain a high degree of squareness for a relatively thick magnet with a thickness of 4 mm or greater, and a high coercivity for a thick NdFeB sintered magnet with a thickness of 5 mm or greater, or 6 mm or greater. As a rough guide, the coercivity to be attained is $H_{cJ}$>1.6 MA/m, or even 1.7 MA/m, by a grain boundary diffusion method using a powder containing Dy in which the base material for the NdFeB sintered magnet contains only Nd or Pr as the rare-earth component and neither Dy nor Tb is contained therein.

Since Dy has far more abundant resources than Tb, the present invention can ensure a stable production of high-coercivity NdFeB sintered magnets. The fruits of the present invention are also applicable to Tb. When the present invention is carried out using Tb, the present invention will be a useful technique for special applications that require even higher levels of $H_{cJ}$. It is also possible to further increase the value of $H_{cJ}$ according to the intended use by employing a base material with Dy or Tb contained therein. By the method according to the present invention, it will be possible to produce an NdFeB sintered magnet having high $B_r$ and $H_{cJ}$) values, which have been conventionally impossible to simultaneously attain. Furthermore, the resource problem of Dy and Tb will also be solved.

(5) Another, additional problem is the cost required for removing, after the grain boundary diffusion process, a surface layer formed for the grain boundary diffusion process. If the grain boundary diffusion process is performed using a fluoride or oxide of Dy or Tb or an alloy of Dy or Tb that has a high melting point and hence does not melt during the grain boundary diffusion process, the remnants of those substances form a floating layer on the surface of the base material after the grain boundary diffusion process. These remnants are harmful to the subsequent surface formation treatment and hence must be removed. Performing machine work for removing the floating layer after the grain boundary diffusion process, in addition to the precise work performed before the grain boundary diffusion, incurs an additional cost and hence is undesirable.

Means for Solving the Problems

A first mode of the present invention developed for solving the previously described problems is a method for producing an NdFeB sintered magnet, including the steps of forming a layer containing Dy and/or Tb on the surface of an NdFeB sintered magnet base material and then performing a grain boundary diffusion process for diffusing Dy and/or Tb from the aforementioned layer through the crystal grain boundaries of the magnet base material into the magnet base material by heating the magnet base material to a temperature equal to or lower than the sintering temperature thereof, which is characterized in that:

a) the content of a rare earth in a metallic state in the magnet base material is equal to or higher than 12.7 at %;

b) the aforementioned layer is a powder layer formed by depositing a powder; and c) the powder layer contains 50 mass % or more Dy and/or Tb in a metallic state.

In the present invention, the "rare earth in a metallic state" means a rare-earth element constituting a metal in an NdFeB sintered magnet, where the "metal" is either a pure metal, an alloy, or an intermetallic compound including the mother phase of $Nd_2Fe_{14}B$. The "rare earth in a metallic state" does not include any compounds having an ionic bond or covalent bond, such as an oxide, fluoride, carbide or nitride of a rare earth.

The "powder layer" containing "50 mass % or more Dy and/or Tb in a metallic state" may be a powder layer being entirely formed by Dy and/or Tb in a metallic state, i.e. a powder layer composed of Dy and/or Tb by 100 mass %.

The "Dy and/or Tb in a metallic state" means Dy and/or Tb constituting a metal in the powder layer applied on a base material for the grain boundary diffusion process. Also in this case, the "metal" includes pure metals, alloys and intermetallic compounds and does not include fluorides, carbides, oxides and nitrides of those rare earths. Hydrides of those rare earths, as well as hydrides of intermetallic compounds containing those rare earths, are some kinds of intermetallic compounds, and the rare earths constituting such compounds are regarded as being in a metallic state. Most of the hydrogen atoms contained in these hydrides dissipate from the powder layer before the grain boundary diffusion of Dy and/or Tb into the base material begins. Therefore, in this patent application, hydrogen contained in the hydride is not considered in the calculation of the composition of the powder layer. When the composition is expressed in mass %, the difference in atomic weight between the rare earths and hydrogen becomes extremely large, so that the calculated values change little irrespective of whether or not the presence of hydrogen is considered in the compositional calculation.

The technical meaning of requirement a), "the content of a rare earth in a metallic state . . . is equal to or higher than 12.7 at %", is hereinafter described. The main phase of an NdFeB sintered magnet is the $Nd_2Fe_{14}B$ compound. Since the stoichiometric composition of Nd:Fe:B=2:14:1, the atomic percentage of the rare earth is 2/17=11.76 at %. The NdFeB sintered magnet has an Nd-rich phase and a B-rich phase in addition to the main phase. The present inventors have discovered that the grain boundary diffusion method effectively works on the NdFeB sintered magnet only when an adequate amount of the Nd-rich phase in a metallic state is present at the grain boundaries. In the grain boundary diffusion process, Dy or Tb is transported from the Dy/Tb-abundant layer, which is formed on the surface, through the grain boundaries into the sintered base material. The requirement a) is indispensable to increase the diffusion rate of Dy or Tb through the grain boundaries and accelerate the diffusion of these elements into deeper regions of the base material. When the amount of the rare earth in a metallic state is equal to or higher than a certain level that exceeds the stoichiometric composition, a thick channel of Nd-rich phase in a molten state is formed within the grain boundaries during the grain boundary diffusion process, enabling Dy or Tb to diffuse at high rates from the surface region deeper into the base material. In the present invention, the amount of the rare earth in a metallic state required for a base material to attain a high coercivity of 1.6 MA/m or 1.7 MA/m is calculated by subtracting the amount of the rare earth that has been oxidized, carbonized or nitrided into an oxide, carbide or nitride, respectively, from the amount of all the rare earth contained in the sintered base material. The present inventors have discovered that, for the grain boundary diffusion process to effectively work, the amount of the rare earth in a metallic state needs to be equal to or higher than 12.7 at %, which exceeds the rare-earth percentage of the stoichiometric composition of the $Nd_2Fe_{14}B$ phase (11.76 at %) by approximately 1 at %. If an adequate amount of rare earth in a metallic state is contained in the base material, a large amount of Nd-rich phase is formed in the grain boundaries and the grain boundary diffusion proceeds efficiently. As a result, the coercivity will be enhanced to high levels that could not be attained by the conventional grain diffusion boundary methods. Furthermore, the grain boundary diffusion method becomes effective even for thick base materials.

It is generally known that reducing the oxygen content of an NdFeB sintered magnet base material increases the coercivity of the base material. However, the amount of increase in the coercivity due to the oxygen-content reduction of the base material is rather small as compared to the effect of the present invention. The effects of the grain boundary diffusion method according to the present invention (i.e. an NdFeB sintered magnet with an extremely high coercivity can be created, the coercivity-increasing effect of the grain boundary diffusion process occurs even in a thick magnet, and a high degree of squareness is obtained even for a relatively thick magnet) are attributable to the fact that the therein used NdFeB sintered magnet base material contains a large amount of rare earth in a metallic state, as a result of which an Nd-rich phase is abundantly formed in the grain boundaries, which helps the grain boundary diffusion of Dy or Tb applied to the surface of the base material, so that the coercivity-increasing effect of these elements can penetrate deeper into the base material.

The amount of the rare earth in a metallic state is analyzed and measured in the following manner: To begin with, chemical analyses are performed to determine the amounts of all the rare earths, oxygen, carbon and nitrogen contained in the NdFeB sintered magnet. On the assumption that the oxygen, carbon and nitrogen atoms respectively form $R_2O_3$, RC and RN (where R is the rare earth), the amount of the rare earth that becomes in a non-metallic state due to their bonding with oxygen, carbon and nitrogen is subtracted from the entire amount of the entire rare earth. The obtained difference is assumed to be the amount of the rare earth in a metallic state. The present inventors have discovered that, when the amount of the rare earth in the base material calculated in this manner is equal to or greater than the aforementioned value, i.e. 12.7 at %, it is possible to attain a high coercivity of 1.6 MA/m, or even 1.7 MA/m, by a grain boundary diffusion process using Dy even if the base material contains neither Dy nor Tb and has a large pole area and a relatively large thickness of 3 mm or greater.

Next, the technical meaning of condition b) is described. This condition is necessary for industrially carrying out the grain boundary diffusion method for an NdFeB sintered magnet. The conventionally used sputtering process is industrially worthless since it is too low in productivity and too high in processing costs. The most suitable method for applying a powder to the surface of the base material is the barrel painting method (refer to Japanese Unexamined Patent Application Publication No. 2004-359873). A spray method or similar technique using a solvent is also feasible to apply the powder.

Next, the technical meaning of condition c) is described. One thing that is missed in the conventional literature relating to the grain boundary diffusion method is the importance of the amount of Dy or Tb to be applied to the surface of the base material. The present inventors have discovered that, under the conditions that the aforementioned requirement a) is satisfied, an adequate amount of rare earth in a metallic state is present in the base material, and a large amount of rare-earth rich phase is present in the grain boundaries, when a layer containing a large amount of Dy or Tb in a metallic state is deposited on the surface of the base material, a large amount of these metals diffuse through the grain boundaries deeper into the base material, as a result of which an NdFeB sintered magnet having a high coercivity that could not be attained is created, and the coercivity of thick magnets can be enhanced. The condition c) is necessary for depositing a large amount of Dy or Tb in a metallic state on the surface of the base material. If a large amount of Dy or Tb is deposited on a base material that does not satisfy the condition a), the grain boundary diffusion of these metals occurs either at extremely low rates or within a limited region near the surface. Therefore, the coercivity enhancement attained by the grain boundary diffusion is rather small, and the method is not effective for thick magnets. In all the examples in Patent Document 4 as a conventional technique, the coercivity attained by the grain boundary diffusion process is not higher than 1.290 MA/m when the base material contains neither Dy nor Tb. One probable reason for this result is that the amount of Dy contained in the used powder was as low as 15 to 20 at % (approximately 30 to 38 mass %).

The second mode of the method for producing an NdFeB sintered magnet according to the present invention is a variation of the first mode of the production method and characterized in that the amount of the powder layer on the surface the magnet base material is equal to or more than 7 mg per 1 $cm^2$. By this method, a large amount of Dy or Tb in a metallic state can be deposited on the surface of the base material, so that the coercivity can be further enhanced.

The third mode of the method for producing an NdFeB sintered magnet according to the present invention is a variation of the first or second mode of the production method and characterized in that the powder layer contains 1 mass % or more Al. This composition even further enhances the coercivity of the NdFeB magnet.

The fourth mode of the method for producing an NdFeB sintered magnet according to the present invention is a variation of one of the first through third modes of the production methods and characterized in that the powder layer contains 10 mass % or more Co and/or Ni in total. This composition gives corrosion resistance to the surface layer formed on the base material after the grain boundary diffusion. That is, the NdFeB sintered magnet produced by the fourth-mode method is characterized in that a surface layer tightly adhered on the surface of the base material is formed after the grain boundary diffusion. If the percentage of Co and/or Ni contained in this surface layer is equal to or larger than a certain level, the surface layer exhibits a corrosion-preventing effect on the base material.

The fifth mode of the method for producing an NdFeB sintered magnet according to the present invention is a variation of one of the first through fourth modes of the production methods and characterized in that the powder layer is melted during the grain boundary diffusion process.

The technical meaning of the fifth mode of the method for producing an NdFeB sintered magnet is hereinafter described. One of the characteristics of the powder used in each mode of the present invention is its high composition ratio of the rare earth. As stated in c) of the first mode, the rare-earth content is equal to or higher than 50%, including the case of 100%. If the amount of the transition element (e.g. Fe, Co, Ni, Mn or Cr) and/or any other metallic element (e.g. Al or Cu) added to the rare earth (e.g. Nd or Dy) is increased, the melting point of the mixture rapidly decreases and the mixture forms a eutectic crystal at a specific composition (eutectic point). If the amount of the additive element is further increased beyond the composition of this eutectic point, the melting point increases. Concerning the grain boundary diffusion method of an NdFeB sintered magnet, the present inventors have discovered that, if a high coercivity of 1.6 MA/m or 1.7 MA/m is to be attained by a grain boundary diffusion process using only Dy for a base material containing neither Dy nor Tb, it is desirable that the Dy-containing powder layer applied to the base material should have a high rare-earth composition containing pure Dy, and the entirety, or at least one half, of the powder layer should be melted by the eutectic phenomenon. That is, in the grain boundary diffusion process, the powder layer applied to the base material should react with either a component of itself or a component of the base material to reach a composition near the eutectic point and be melted. In the grain boundary diffusion process, when the Dy-containing layer applied to the base material is in such a molten state, the applied layer and an Nd-rich phase, which exists in crystal boundaries extending from the inner regions to the surface of base material, are connected as in their liquid state, which enables Dy in the applied layer to be efficiently transported to the inner regions of the base material. For such a phenomenon to occur, the applied powder layer needs to have a high rare-earth composition. Since the powder layer contains Dy and/or Tb in a metallic state at a high concentration equal to or higher than 50 mass %, the liquid formed by melting the powder layer has a high viscosity, so that the liquid will not flow off the surface of the base material at normal processing temperatures in the grain boundary diffusion process.

The powder layer may be composed of pure Dy. Pure Dy has a melting point of 1412° C., which is higher than the sintering temperature of the NdFeB sintered magnet. However, the applied Dy reacts with Fe or other components of the base material and decreases the melting point, to form a eutectic crystal with Fe or other elements and melt at 800° to 1000° C. which the heating temperature for the grain boundary diffusion process.

When Fe, Ni, Co, Mn, Cr, Al, Cu and/or other elements are added to the pure Dy in the composition of a powder to be applied, the melting point of the powder layer decreases as the amount of the added element increases until it reaches the eutectic point. After this point, if the amount of the added element is further increased, the melting point of the powder layer increases. A preferable range of the composition of the powder layer is a composition range with a melting point equal to or lower than 1000° C. before and/or after the eutectic point on a state graph.

Even if the melting point of a composition with a Dy content higher than that of the eutectic point is equal to or higher than 1000° C., the melting point decreases, as described previously, as the powder layer forms a eutectic crystal with Fe or other constituent elements of the base material. Therefore, the applied powder layer will melt during the grain boundary diffusion process (normally at temperatures equal to or lower than 1000° C.), causing an efficient diffusion of Dy. When the amount of the elements added to Dy is increased beyond the eutectic point to a composition with which the powder layer has a melting point equal to or higher than 1000° C., the powder layer will not be entirely melted even if the heat treatment for the grain boundary diffusion is performed at 1000° C. which the upper limit of the grain boundary diffusion temperature, and the grain boundary diffusion continues with solid components included therein.

To obtain the intended high coercivity by the grain boundary diffusion method, it is rather undesirable to leave the situation where the applied powder layer does not melt but remains in the form of powder during the grain boundary diffusion process. The process conditions, such as the composition of the powder layer containing Dy and/or Tb and the heating conditions, should be correctly regulated to melt the powder layer during the grain boundary diffusion process, whereby the coercivity of the NdFeB sintered magnet can be enhanced and, furthermore, the surface layer, which is formed on the surface of the base material of the NdFeB sintered magnet after the grain boundary diffusion process, can be tightly adhered to the base material. A surface layer that easily peels off the base material must be removed for practical reasons. However, if the surface layer is tightly adhered, one can leave it intact or can perform a surface treatment additionally on the surface layer. Thus, the cost for the machine working can be saved. Furthermore, if Ni or Co is included in the powder layer, the surface layer formed after the grain boundary diffusion process will have a corrosion-preventing effect on the base material, so that the surface treatment cost can be saved.

The first mode of the NdFeB sintered magnet according to the present invention is an NdFeB sintered magnet with Dy and/or Tb diffused through grain boundaries by a grain boundary diffusion method, which is characterized in that:

the magnet base material is a plate-shaped magnet base material having a thickness of 3.5 mm or greater;

the amount of the rare earth in a metallic state contained in the plate-shaped magnet base material is 12.7 at % or greater; and an SQ value indicating the squareness of the magnetization curve is 90% or greater.

The SQ value is defined as $H_k/H_{cJ}$, where $H_k$ is the absolute value of the magnetic field at the point where the magnetization is 10% lower than the maximum point of the magnetization curve, and $H_{cJ}$ is the coercivity. An SQ value equal to or higher than 90% means that the Dy and/or Tb has been diffused through the grain boundaries to the regions close to the center of the magnet base material. The reason why a high SQ value that equals or exceeds 90% has been attained for a plate-shaped magnetic base material having a large thickness of 3.5 mm or greater is that Dy and/or Tb can be more easily diffused through the grain boundaries during the grain boundary diffusion process when the amount of the rare earth in a metallic state contained in the magnet base material is 12.7% or higher.

The second mode of the NdFeB sintered magnet according to the present invention is a variation of the first mode of the NdFeB sintered magnet and characterized in that Al is contained in the vicinity of the grain boundaries thereof and in the vicinity of the surface thereof.

The third mode of the NdFeB sintered magnet according to the present invention is a variation of the first or second mode of the NdFeB sintered magnet and characterized in that Co and/or Ni is contained in the vicinity of the grain boundaries thereof and in the vicinity of the surface thereof.

EFFECT OF THE INVENTION

By the first mode of the method for producing an NdFeB sintered magnet and the first mode of the NdFeB sintered magnet, one can obtain an NdFeB sintered magnet with high coercivity and high residual magnetization that could not be attained by the conventional grain boundary diffusion methods. It is also possible to create an NdFeB sintered magnet having a large thickness and yet with high squareness and high coercivity, which has been previously impossible to create by the grain boundary method. These qualities can be further improved by the second to fifth modes of the method for producing an NdFeB sintered magnet as well as the second and third modes of the NdFeB sintered magnet.

BRIEF DESCRIPTION OF THE DRAWINGS

FIG. 1 is a table showing the compositions of the base materials for the NdFeB sintered magnet used in Examples 1 to 3 of the NdFeB sintered magnet according to the present invention and Comparative Example.

FIG. 2 is a table showing the compositions of the powders used in the grain boundary diffusion process in Examples 1 to 4 and Comparative Examples.

FIG. 3 is a table showing the result of coercivity measurements of NdFeB sintered magnets in Example 1 and Comparative Example.

FIG. 4 is a table showing the result of measurements of the coercivity and SQ value, an index for the squareness of magnetization curve, of NdFeB sintered magnets in Example 2 and Comparative Example, each using a relatively thick base material (thickness: 5 to 6 mm).

FIG. 5 is a table showing the result of coercivity measurements of NdFeB sintered magnets produced by a grain diffusion boundary process using a powder free of Al (Example 3).

FIG. 6 is a table showing the compositions of the powders used in the grain boundary diffusion process in Example 4.

FIG. 7 is a table showing the result of measurements of the coercivity and SQ value of NdFeB sintered magnets in Example 4.

BEST MODE FOR CARRYING OUT THE INVENTION

The NdFeB sintered magnet base material used in the present invention is created by the same process as in the case of creating conventional NdFeB sintered magnets. That is, the creation process includes melting an alloy, coarse pulverization, fine pulverization, orientation in a magnetic field, as well as molding and sintering. However, to obtain a sintered body containing 12.7 at % or a greater amount of rare earth in a metallic state after the sintering process, it is necessary to appropriately regulate the alloy composition and carefully prevent a preferential decrease in the amount of the rare earth and an intrusion of impurities, which occur during the process. The preferential decrease in the amount of the rare earth may possibly occur due to the vaporization or oxidation of the rare-earth component in a metallic state or its reaction with a crucible during the alloy-melting process. The decrease may also occur when the Nd-rich phase is too finely pulverized during the pulverization process to be trapped by a collection container. It is well known that the amount of the rare earth in a metallic state significantly decreases after the pulverization. The decrease in the amount of the rare earth in a metallic state may also result from a chemical reaction of the rare earth in the powder with impurities after the alloy pulverization. These impurities are mostly oxygen, carbon and nitrogen. The inclusion of oxygen into the product occurs primarily due to the oxidation of the powder during and after the alloy pulverization process, the inclusion of carbon due to the residue of a lubricant added for the lubricating the powder, and the inclusion of nitrogen due to the reaction of the powder with the nitrogen in the air. To create a sintered magnet base material for the present invention, it is necessary to minimize the reduction in the amount of the rare earth in a metallic state during the process and reduce the contamination by impurity elements to the lowest possible level. If these measures cannot be taken, it is necessary to increase the amount of the rare earth to be included beforehand in the alloy. The base material #6 in Example 1, which will be described later, is an example that had a low rare-earth content and hence was created while reducing the contamination by oxygen and carbon to the lowest possible level. The base material #5 is an example for which the contamination by carbon during the process could not be reduced, so that the amount of the rare earth in the alloy was increased in order to regulate the amount of the rare earth in a metallic state to fall within the specified range of the present invention.

The lower limit of the amount of the rare earth in the alloy is calculated by adding 12.7 at % to the sum of the amount of rare earth reduced during the pulverization process and the amount of rare earth consumed by oxygen, carbon and nitrogen during or after the pulverization process. If a large amount of rare earth is contained in the alloy, it is possible to carry out the present invention while allowing some level of contamination by those elements. However, if an excessive amount of rare earth is present, the magnetization and maximum energy product of the eventually obtained NdFeB sintered magnet will be low, making the magnet less valuable. A practical upper limit of the amount of the rare earth in the alloy is 16 at %. The rare-earth components in the alloy should be primarily Nd, although it may be partially replaced by Pr according to the material situation. It is possible to partially replace Nd by Dy or Tb according to the level of coercivity required by the final product.

The NdFeB sintered magnet created in this manner undergoes machine work to be shaped into a form and size required as the final product. Subsequently, its surface is cleaned, either chemically or mechanically, before the grain boundary diffusion process. The NdFeB sintered magnet thus obtained is the base material to be eventually used in the present invention.

The powder to be applied on the surface of the base material for the grain boundary diffusion process is hereinafter described. The powder used in the present invention needs to contain 50 mass % or more Dy and/or Tb in a metallic state. Either an alloy powder or mixed powder is used as this powder. The alloy powder is created by preparing an alloy of Dy or/and Tb and another metal beforehand and then pulverizing this alloy. The mixed powder is either a pure metallic powder of Dy or Tb, or a mixture of the pure metallic powder and a powder of another kind of metal, The alloy powder or mixed powder may be hydrogenised for the sake of pulverization. It is well known that hydrogenising a rare earth or an alloy containing a rare earth makes it more fragile and easier to be pulverized. The hydrogen atoms contained in this metal or alloy can be removed by heating the powder before the powder is applied to the base material for the grain boundary diffusion process. Even if a portion of the hydrogen atoms remains in the powder, the hydrogen atoms will dissipate from the powder before the grain boundary diffusion begins during the heat treatment after the powder is applied to the base material for the grain boundary diffusion. Such hydrogen that leaves before the grain boundary diffusion as well as other gaseous components adsorbed on the powder and resin components used for applying the powder, will not be considered in calculating the composition of the powder.

The powder applied to the surface of the base material may contain other necessary components in addition to Dy and/or Tb, such as a rare-earth element other than Dy and Tb, a 3d transition element (e.g. Fe, Co or Ni), an element that is thought to improve the wettability of the alloy on the base material (e.g. Al or Cu), or B, which is also contained in the NdFeB sintered magnet. The additive amount of these elements should be regulated so that at least one half of the powder layer will be melted during the grain boundary diffusion process. By selecting a powder having such a composition, one can achieve the objective of the present invention. The grain size of the powder should be preferably within a range from 0.1 to 100 μm.

The method of applying the powder is hereinafter described. The powder application method most suitable for carrying out the present invention is the barrel painting method (refer to Japanese Unexamined Patent Application Publication No. 2004-359873). An adhesive layer is initially formed on an NdFeB sintered magnet base material having a clean surface. The optimal range of the thickness of the adhesive layer is from 1 to 5 μm. The substance for forming the adhesive layer may be any adhesive substance that does not corrode the surface of the base material. Most commonly used substances are liquid organic substances, such as epoxy or paraffin. No curing agent is required if an epoxy or similar substance is used. In this adhesive layer application method, a small amount of liquid organic substance is put in a container filled with ceramic or metallic spheres of 0.5 to 1 mm in diameter (which is hereinafter called the impact media) and then stirred, after which the aforementioned base material is put in the container and the entire container is vibrated, whereby an adhesive layer is formed on the surface of the base material. Subsequently, a powder to be applied is put in another container, which is similarly filled with impact media, after which the base material with the adhesive layer formed thereon is put in this container and the entire container is vibrated to form a powder layer on the surface of the base material. The amount of the powder thus applied is within a range from approximately 2 mg to approximately 30 mg per 1 $cm^2$ on the surface of the base material. In the present invention, the amount of the powder is regulated to be equal to or larger than a specific value by controlling the amount of the liquid substance added to the impact media in the adhesive layer formation process and the amount of the powder added to the impact media in the powder application process. A preferable range of the amount of the powder to be applied is from 5 to 25 mg per 1 $cm^2$ on the surface of the base material. The powder application process should preferably be performed in an inert gas atmosphere to prevent the oxidation of the powder.

It is preferable to apply the powder to the base material as densely as possible. If the density of the applied powder is low, not all the applied powder may be absorbed by the base material during the grain boundary diffusion process. That is to say, it is possible that, among the applied powder, only a small portion being in contact with the base material participate in the grain boundary diffusion, while the other portion of the powder existing near the surface of the powder layer are left unused without fulfilling the intended role. The powder application method performed in the present invention builds up the powder layer while impacting the powder layer with the impact media (i.e. small spheres made of a metal or ceramic). The powder layer formed in this manner has a relatively high density. Another possible method for forming a high-density powder layer is to create a powder layer by a method carried out in Patent Document 4 and press the powder layer from above to a base material by means of a rubber plate or similar tool.

Next, the base material to which the powder containing Dy and/or Tb has been applied is put in a furnace and heated. The atmosphere inside the furnace is either a vacuum or a high-purity inert gas atmosphere. With the increase in the temperature of the furnace, the gas components adsorbed on the powder and the liquid substance components used in the barrel painting process dissipate from the powder. A further increase in the temperature causes the dissipation of hydrogen from the powder. Subsequently, at around the point where the temperature exceeds 700° C., the powder begins to react with the base material, causing the grain boundary diffusion. For the grain boundary diffusion to effectively proceed, it is desirable that the applied powder be melted to be tightly adhered to the base material. To create such a condition, the heating temperature needs to be raised to 800° C. or even higher. Increasing the temperature to above 1000° C. would not only accelerate the grain boundary diffusion but also result in too high a diffusion rate within each grain, so that it would be impossible to create a fine structure having high concentrations of Dy and/or Tb only in the vicinity of the grain boundaries. Accordingly, it is desirable that the heating temperature for the grain boundary diffusion be 1000° C. or lower. The normal heating condition is 800° C. for 10 hours or 900° C. for 3 hours. After this heating process is completed, a heat treatment that normally follows the sintering process or a heat treatment known as an aging treatment is performed.

The NdFeB sintered magnet created by the previously described process has high coercivity and high residual magnetization that exceed the qualitative limits of the NdFeB sintered magnets created by conventional grain boundary diffusion methods. Even when the magnet is relatively thick, a high-quality NdFeB sintered magnet having a magnetization curve with high squareness can be created by the grain boundary diffusion process. Unlike the conventional grain boundary diffusion methods, which are not applicable to thick magnets, the previously described process can attain a high coercivity even for a thick magnet having a thickness of 5 to 6 mm. That is to say, when a conventional method is applied to a thick magnet, only the region close to the surface of the base material is highly magnetized and the grain boundary diffusion effect does not reach inner regions, so that the squareness of the magnetization curve is low. This unfavorable characteristic is typically found in a magnet having a high coercivity portion and low coercivity portion intermixed, which is regarded as a sign of a low-quality product. By the present invention, it is possible to create a high-quality product of the NdFeB sintered magnet having a magnetization curve with high squareness even if the product is relatively thick. Furthermore, the method according to the present invention does not require removing the surface layer from the created NdFeB sintered magnet after the grain boundary diffusion process since the powder layer applied for the grain boundary diffusion process is melted and tightly adhered to the base material during the grain boundary diffusion. When Ni or Co is added to the powder for the grain boundary diffusion process, the surface layer formed on the surface will have a corrosion-preventing effect on the base material.

EXAMPLE 1

An NdFeB sintered magnet powder was prepared by the steps of creating an alloy by a strip-casting method, performing hydrogen pulverization, mixing a lubricant, and performing a fine pulverization by a jet mill using nitrogen. After a lubricant was mixed into this powder, the orientation process in a magnetic field and the molding and sintering processes were performed. By this procedure, ten kinds of NdFeB sintered magnet blocks (base materials) having different compositions were created (FIG. 1). In FIG. 1, the prefix "(Comp)" in the "Base No." field denotes the base materials of the comparative examples. The other figures (Nos. 1 to 6) are the base materials used in the present example. The compositions shown in FIG. 1 are the values obtained by chemical analyses of sintered bodies after the sintering process. The compositions of the sintered bodies were varied by changing the composition of the strip-cast alloy, the purity of the nitrogen gas used in the jet-mill pulverization process or the amount of oxygen added in the same process, as well as the kind and amount of the lubricant added before and after the jet-mill pulverization. In any of these cases, the diameter of the fine powder after the jet-mill pulverization was controlled so that the median ($D_{50}$) of the distribution of the grain size measured by a laser diffraction method would be 5 μm. Any of these ten kinds of sintered magnets contains only Nd as the rare earth. This is approximate to the composition of NdFeB sintered magnets produced in large volume by magnet makers as a material that yields the largest maximum magnetic energy product. However, it should be noted that the magnets of Base Nos. 1 to 6 were created under specifically devised conditions for minimizing the contamination due to impurities. By contrast, the compositions of the magnets of Base Nos. "(Comp) 1" to "(Comp) 4" are all approximate to those of commercially available products. In FIG. 1, the MR value shows the amount of the rare earth in a metallic state, which was calculated from the value obtained by a chemical analysis of the sintered magnet. That is to say, the MR value was a value obtained by subtracting the amount of the rare earth consumed (non-metalized) by oxygen, carbon and nitrogen from the entire amount of the rare earth obtained by the analysis. In the calculation, it was assumed that the aforementioned impurity elements combined with the rare earth to form $R_2O_3$, RC and RN, respectively (where R represents the rare-earth element).

The powder to be applied to the surface of the NdFeB sintered magnet base material for carrying out the grain boundary diffusion method is hereinafter described. FIG. 2 shows the compositions of the powder used in the experiment. The prefix "(Comp)" in the "Powder No." field denotes the powders of the comparative examples. Powder Nos. 1 to 6 and 13 to 15 were each prepared by mixing the powders of the component elements concerned, except Dy, for which a powder of its hydride, $DyH_3$, was used. During the heat treatment for grain boundary diffusion process, the hydrogen atoms in $DyH_3$ are released to the outside of the system at temperatures lower than the temperature at which the grain boundary diffusion begins. Therefore, each powder was prepared on the assumption that the powder contained no hydrogen. $DyH_3$ has a grain size of approximately 30 μm, while the powders of the other component elements each have a grain size within a range from 5 to 10 μm. Powder Nos. 7 to 12 and "(Comp) 1" to "(Comp) 3" were obtained by the steps of creating a thin strip of alloy with a thickness of 80 μm by a strip-casting method and then finely pulverizing the thin strip by directly putting it into a jet mill without performing the hydrogen pulverization. The grain size of the fine powder was controlled to have a median $D_{50}$ of 5 μm.

A grain boundary diffusion experiment was performed using rectangular parallelepiped samples each measuring 7 mm in length, 7 mm in width and 3.5 mm in thickness, with the thickness direction coinciding with its magnetization direction, which were respectively cut out from the ten kinds of sintered blocks shown in FIG. 1. The powder application process was as follows: 100 $cm^3$ of small zirconia spheres having a diameter of 1 mm were put in a 200 $cm^3$ plastic beaker, in which 0.1 to 0.5 g of liquid paraffin was added and stirred. Then, a rectangular parallelepiped sample of the NdFeB sintered magnet was put in the beaker, and this beaker was brought into contact with a vibrator to apply an adhesive layer (liquid paraffin) on the surface of the rectangular parallelepiped sample. Subsequently, 8 $cm^3$ of small stainless spheres having a diameter of 1 mm were put in a 10 $cm^3$ glass bottle, in which 1 to 5 g of a powder shown in FIG. 2 was added, and the rectangular parallelepiped sample of the sintered body with the previously formed adhesive layer was put in the bottle. However, this time, the lateral sides (the sides other than the pole faces) of the rectangular parallelepiped sample were covered with plastic masking plates to prevent the powder from sticking to those sides of the magnet. The glass bottle including the rectangular parallelepiped sample, with the masks put thereon and the adhesive layer formed thereon, was brought into contact with the vibrator, whereby an NdFeB sintered magnet having a Dy-containing powder applied only on its pole faces was created. The amount of the applied powder was varied by changing the amounts of the added liquid paraffin and the powder in the previously described process.

The reason for limiting the powder application area to the pole faces is as follows: The present invention is intended to be applied to relatively large motors. Therefore, it must be a technique that effectively works on a magnet having a relatively large pole area. However, due to the magnetization curve measurement apparatus, the pole area was unavoidably limited. Accordingly, while using a sample with a relatively small pole area of 7×7 mm, a situation similar to an experiment of a grain boundary diffusion process for a sample having a large pole area was created by designedly excluding the lateral sides from the powder application process.

The sample, on which the powder had been applied, was placed on a molybdenum plate, with one of its lateral sides on the bottom side, and heated under a vacuum of 10--4 Pa. The heating temperature was 900° C. and continued for 3 hours. Subsequently, the sample was rapidly cooled to near room temperature and then heated at 500 to 550° C. for 2 hours, after which it was once more cooled to room temperature. In this manner, a plurality of samples with various combinations of the base material, the powder and the amount of powder application were created, and their coercivity was measured. The measurement results are shown in FIG. 3.

The results in FIG. 3 show that the samples falling within the scope of the present invention (Samples Nos. 1 to 19) attained high coercivities of 1.6 MA/m or higher by a grain boundary diffusion method using Dy; the samples for which the amount of the applied powder was 7 $mg/cm^2$ or greater had coercivities of 1.7 MA/m or greater. No conventional techniques could attain such a high coercivity when a grain boundary diffusion method using Dy was performed under the conditions that neither Dy nor Tb was contained in the base material of the NdFeB sintered magnet and the sample had a relatively large thickness of 3.5 mm as well as a large pole area. It has been also confirmed that even higher coercivities can be obtained when the powder to be applied contains Tb in a metallic state (Sample No. 15). The experimental results of Sample Nos. "(Comp) 1" to "(Comp) 4" demonstrate that the coercivity cannot be higher than 1.6 MA/m when the amount of the rare earth in a metallic state contained in the base material is not higher than 12.7 at %.

EXAMPLE 2

An experiment similar to Example 1 was performed for relatively thick base materials. The sample was a rectangular parallelepiped body of 5 or 6 mm in thickness (as written in FIG. 4) having a square pole face, 7 mm on one side, with the thickness direction coinciding with its magnetization direction. Similar to the case of Example 1, the sides other than the pole faces were masked so as to apply a DY-containing powder to only the pole faces. The powder was applied by a band painting method under the same conditions as used in Example 1. The conditions of the grain boundary diffusion process and the aging treatment were also the same as Example 1. FIG. 4 shows the measurement results of the magnetic characteristics of the samples created under the conditions falling within the scope of the present invention as well as those created under the conditions that do not fall within the scope of the present invention. In addition to the coercivity $H_{cJ}$, this figure shows the residual flux density $B_r$, the demagnetization field $H_k$ for causing a 10% reduction of the magnetization, and the value of $H_k/H_{cJ}$, which is a frequently used index of the squareness of a magnetization curve. $H_k/H_{cJ}$ is denoted by "SQ (Squareness)."

The results shown in FIG. 4 demonstrate that the NdFeB sintered magnets created by the method according to the present invention (Sample Nos. 20 to 25) have coercivities of 1.6 MA/m or higher for both thicknesses of 5 mm and 6 mm. It is a breakthrough achievement that their SQ values have exceeded 90%. A high SQ value demonstrates that the grain boundary diffusion has reached the center of the sample. The fact that high SQ values has been attained for the samples having a thickness of 6 mm, with the Dy-containing powder applied to only the pole faces, shows that Dy in the powder applied to the sample surface has penetrated 3 mm from both ends as a result of the 900° C. heat treatment. This is outside the common knowledge about the conventional grain boundary diffusion methods. This means that the grain boundary diffusion of Dy and/or Tb can reach deep inside beyond the conventionally recognized limits if the conditions of the present invention are satisfied.

In the comparative examples, Sample Nos. "(Comp) 5" to "(Comp) 8" show the results of experiments where the powder applied to the base material did not satisfy the conditions of the present invention, and Sample Nos. "(Comp) 9" to "(Comp) 11" show the results of experiments where the base material for the NdFeB sintered magnet did not satisfy the conditions of the present invention. Specifically, Sample Nos. "(Comp) 5" to "(Comp) 8" are the cases where the content of Dy and/or Tb in the powder to be applied to the base material was low, and the coercivity and the SQ value attained by the grain boundary diffusion process were low. Sample Nos. "(Comp) 5" to "(Comp) 8" are the cases where the amount of the rare earth in a metallic state contained in the NdFeB magnet base material used was lower than 12.7 at %, and the coercivities and SQ values of the samples obtained by the grain boundary diffusion process were lower than those of the samples created under the conditions of the present invention. These results demonstrate that, in order to cause Dy or Tb in the powder layer applied to the base material to penetrate deep inside the base material so as to realize an NdFeB sintered magnet that is relatively thick and yet has a high coercivity and large SQ value, it is necessary to satisfy the conditions of the present invention

EXAMPLE 3

A grain boundary diffusion measurement was performed under the same conditions as Example 1 except that Al-free powders (Powder Nos. 13 to 15) were applied to the same base materials as used in Example 1. The result is shown in FIG. 5. Comparison of the results of Example 3 with those of Example 1 demonstrates that higher coercivities can be attained by the present invention when Al is contained in the powder to be applied. It is estimated that Al works effectively in melting the applied powder.

EXAMPLE 4

Examples 1 to 3 demonstrated the effectiveness of the present invention for the case where neither Dy nor Tb was contained in the base material. The present example shows the results of experiments using NdFeB sintered magnets having the compositions shown in FIG. 6 for the case where Dy was contained in the base material. The samples used in the experiments had a thickness of 3.5 mm and were created under the same powder application condition, grain boundary diffusion condition, and other conditions as in Example 1. FIG. 7 shows the results of the present example in comparison to the cases where Dy was not contained in the base material. FIG. 7 demonstrates that, when a base material containing Dy is used, an NdFeB sintered magnet with extremely high characteristics can be obtained since the increase in the coercivity of the base material due to the presence of Dy in the base material is added to the increase in the coercivity due to the grain boundary diffusion process. Even when Dy is contained in the base material, if the amount of the rare earth in a metallic state is not adequately large, it is impossible to obtain a high level of grain boundary diffusion effect. This is similar to the case where neither Dy nor Tb is contained in the base material. The extremely high coercivities and SQ values of Sample Nos. 32 to 35 in FIG. 7 are due to the fact that the base materials Nos. 11 and 12 both contained Dy and, furthermore, had large MR values.

EXAMPLE 5

A corrosion resistance test was performed on some of the samples created in the experiment of Example 1. The test was conducted using two groups of samples; the first sample group included Sample Nos. 3, 5 and 6, and the second sample group included Sample Nos. 1, 13 and an NdFeB sintered magnet sample created without performing a grain boundary diffusion process. Both groups were left in an air saturated with steam of 70° C. One hour later, rust was found on the magnets of the second group, while no rust was observed in the first group. When three hours had elapsed, all the magnets were found to be rusted. However, the degree of corrosion on the magnets of the first group was lower than those of the second group. In the magnets of the first group, the powder applied for the purse of the grain boundary diffusion contained 10% or more Ni and/or Co in total, whereas those of the second group were created by either a method without any grain boundary diffusion process or a process in which the powder applied for the sake of the grain boundary diffusion contained neither Ni nor Co. The results of the present example demonstrates that, when a powder applied for the sake of the grain boundary diffusion in the sample of the present invention contains 10% or more Ni and/or Co, the surface layer remaining after the grain boundary diffusion process works as a corrosion protective film. This corrosion-preventing effect is not sufficient under an extremely corrosive environment. However, when the magnets that have been created are stored or transported for the surface treatment, the corrosion-preventing effect prevents the magnets from being rusted on their surfaces to be useless as the products.

Any of the samples created by a method that satisfies the conditions of the present invention had a smooth surface. The surface layer was tightly adhered to the base material. These results confirm that the powder layer applied to the base material melted during the heat treatment for the grain boundary diffusion.

The heat treatment was performed at 900° C. for 3 hours in any of the examples. Additionally, it was confirmed that satisfactory results could be obtained by appropriately regulating the heating time when the temperature was within a range from 800° to 1000° C.

Most of the previously described examples showed the results of experiments that used Dy. The experimental results obtained by Dy are also applicable to the case of Tb since the difference in the effect on the coercivity between Dy and Tb is only based on the difference in magnetocrystalline anisotropy between the $Dy_2Fe_{14}B$ phase and the $Tb_2Fe_{14}B$ phase. The difference between these two elements will be merely reflected in the absolute value of the coercivity; irrespective of whether Dy or Tb is used, the effect due to the difference between the present examples and the comparative examples can be similarly obtained. (Of course, a better result will be obtained when Tb is used.) Accordingly, one can think that the experimental results obtained by using Dy are enough to substantiate the effect of the present invention.

The invention claimed is:

1. A method for producing an NdFeB sintered magnet, including steps of forming a layer containing Dy and/or Tb on a surface of an NdFeB sintered magnet base material and then performing a grain boundary diffusion process for diffusing Dy and/or Tb from the aforementioned layer through crystal grain boundaries of the magnet base material into the magnet base material by heating the magnet base material to a temperature equal to or lower than a sintering temperature of the magnet base material, wherein:

a) a content of a rare earth in a metallic state in the magnet base material is equal to or higher than 12.7 at %;

b) the aforementioned layer is a powder layer formed by depositing a powder;

c) the powder layer contains 50 mass % or more Dy and/or Tb in a metallic state; and d) the powder layer contains 1 mass % or more Al.

2. The method for producing an NdFeB sintered magnet according to claim 1, wherein an amount of the powder layer on the surface the magnet base material is equal to or more than 7 mg per 1 $cm^2$.

3. A method for producing an NdFeB sintered magnet, including steps of forming a layer containing Dy and/or Tb on a surface of an NdFeB sintered magnet base material and then performing a grain boundary diffusion process for diffusing Dy and/or Tb from the aforementioned layer through crystal grain boundaries of the magnet base material into the magnet base material by heating the magnet base material to a temperature equal to or lower than a sintering temperature of the magnet base material, wherein:

a) a content of a rare earth in a metallic state in the magnet base material is equal to or higher than 12.7 at %;

b) the aforementioned layer is a powder layer formed by depositing a powder;

c) the powder layer contains 50 mass % or more Dy and/or Tb in a metallic state; and d) the powder layer contains 10 mass % or more Co and/or Ni in total.

4. The method for producing an NdFeB sintered magnet according to claim 3, wherein the powder layer is melted during the grain boundary diffusion process.

5. The method for producing an NdFeB sintered magnet according to claim 1, wherein the powder layer is melted during the grain boundary diffusion process.

6. The method for producing an NdFeB sintered magnet according to claim 3, wherein an amount of the powder layer on the surface the magnet base material is equal to or more than 7 mg per 1 $cm^2$.

* * * * *